US012674227B2

(12) United States Patent
Tan et al.

(10) Patent No.: US 12,674,227 B2
(45) Date of Patent: Jul. 7, 2026

(54) ALUMINUM PLATED STEEL SHEET, THERMOFORMED COMPONENT, AND MANUFACTURING METHODS

(71) Applicant: BAOSHAN IRON & STEEL CO., LTD., Shanghai (CN)

(72) Inventors: Ning Tan, Shanghai (CN); Hao Liu, Shanghai (CN); Xinyan Jin, Shanghai (CN)

(73) Assignee: Baoshan Iron and Steel Co Ltd (CN)

( * ) Notice: Subject to any disclaimer, the term of this patent is extended or adjusted under 35 U.S.C. 154(b) by 0 days.

(21) Appl. No.: 18/262,156

(22) PCT Filed: Dec. 23, 2021

(86) PCT No.: PCT/CN2021/140835

§ 371 (c)(1),
(2) Date: Jul. 19, 2023

(87) PCT Pub. No.: WO2022/161049

PCT Pub. Date: Aug. 4, 2022

(65) Prior Publication Data

US 2024/0093342 A1 Mar. 21, 2024

(30) Foreign Application Priority Data

Jan. 28, 2021 (CN) ..... 202110119239.0

(51) Int. Cl.
*C23C 2/12* (2006.01)
*C21D 8/00* (2006.01)
(Continued)

(52) U.S. Cl.
CPC ..... *C23C 2/12* (2013.01); *C21D 8/00* (2013.01); *C21D 9/0081* (2013.01);
(Continued)

(58) Field of Classification Search
CPC ..... C22C 38/002; C22C 38/06; C22C 38/26; C22C 38/28; C22C 38/32; C22C 38/34; C23C 2/12; C23C 2/40
(Continued)

(56) References Cited

U.S. PATENT DOCUMENTS

2014/0205857 A1* 7/2014 Goto ..... B32B 15/012 427/398.1
2015/0024237 A1* 1/2015 Tanahashi ..... C22C 38/54 420/104
(Continued)

FOREIGN PATENT DOCUMENTS

CN 1369020 A 9/2002
CN 101565806 A 10/2009
(Continued)

OTHER PUBLICATIONS

Isaki et al., JP4199404B2 Google Patents machine translation printed on Sep. 15, 2024, Dec. 17, 2008, entire translation (Year: 2008).*
(Continued)

*Primary Examiner* — Katherine A Christy
(74) *Attorney, Agent, or Firm* — Elizabeth L. Neal; DeWitt LLP

(57) ABSTRACT

An aluminum plated steel sheet includes a substrate and a plating layer on the surface of the substrate. The microstructure of the plating layer includes a Mg2Si phase and an AlMgSiFe phase; an average grain diameter of the Mg2Si phase is 0.001-5 μm. This aluminum plated steel sheet can alleviate the problem of melting-induced roller sticking and hydrogen embrittlement risk in a thermoforming process of the aluminum plated steel sheet.

20 Claims, 1 Drawing Sheet

(51) Int. Cl.

| | |
|---|---|
| ***C21D 9/00*** | (2006.01) |
| ***C22C 38/00*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C23C 2/28*** | (2006.01) |
| ***C23C 2/40*** | (2006.01) |

(52) U.S. Cl.
CPC ..... *C22C 38/002* (2013.01); *C22C 38/06* (2013.01); *C22C 38/26* (2013.01); *C22C 38/28* (2013.01); *C22C 38/32* (2013.01); *C22C 38/34* (2013.01); *C23C 2/29* (2022.08); *C23C 2/40* (2013.01)

(58) Field of Classification Search
USPC ..... 428/653
See application file for complete search history.

(56) References Cited

U.S. PATENT DOCUMENTS

| | | | | |
|---|---|---|---|---|
| 2020/0032381 | A1 | 1/2020 | Sato et al. | |
| 2021/0340650 | A1 * | 11/2021 | Park | C23C 2/04 |

FOREIGN PATENT DOCUMENTS

| | | | | |
|---|---|---|---|---|
| CN | 103649361 | A | 3/2014 | |
| CN | 106466697 | A | 3/2017 | |
| CN | 107099748 | A | 8/2017 | |
| CN | 109402547 | A | 3/2019 | |
| CN | 109518114 | A | 3/2019 | |
| EP | 1881083 | A1 | 1/2008 | |
| EP | 3266900 | A1 | 1/2018 | |
| EP | 3770295 | A1 | 1/2021 | |
| JP | 2000290763 | A | 10/2000 | |
| JP | 2000328216 | A | 11/2000 | |
| JP | 2001107213 | A | 4/2001 | |
| JP | 2001131725 | A | 5/2001 | |
| JP | 4199404 | B2 * | 12/2008 | |
| JP | 2011514935 | A | 5/2011 | |
| JP | 2012528244 | A | 11/2012 | |
| JP | 2020143370 | A | 9/2020 | |
| RU | 2684801 | C1 | 4/2019 | |
| SU | 1555374 | A1 | 4/1990 | |
| TW | 201920714 | A | 6/2019 | |
| WO | 2013133270 | A1 | 9/2013 | |
| WO | WO-2020067678 | A1 * | 4/2020 | B32B 15/012 |
| WO | 2021171514 | A1 | 9/2021 | |
| WO | 2022161049 | A1 | 8/2022 | |

OTHER PUBLICATIONS

International Search Repost and Written Opinion for PCT Application No. PCT/CN2021/140835, issued Mar. 11, 2022, from the China National Intellectual Property Administration.
First Search for corresponding CN Application No. 202110119239.0, issued from the Chinese Intellectual Property Office on Aug. 8, 2022.
First Office Action for corresponding CN Application No. 202110119239.0, issued from the Chinese Intellectual Property Office on Aug. 17, 2022.
Examination and Search Report for corresponding TW Patent Application No. 110149205, issued on Sep. 23, 2022, from the TW Patent Office.
Notice of Allowance for corresponding TW Patent Application No. 110149205, issued on Feb. 20, 2023, from the TW Patent Office.
"Decision to Grant received for Russian Patent Application No. 2023119472/05, mailed on Apr. 9, 2024", 17 pages. (8 pages of English translation and 9 pages of Official copy).
"Extended European Search Report received for European Patent Application No. 21922639.6, mailed on Oct. 28, 2024", 12 pages.
"Office Action received for Canadian Patent Application No. 3209226, mailed on Aug. 12, 2024", 3 pages.
"Office Action received for Japanese Patent Application No. 2023-544455, mailed on Oct. 22, 2024", 6 pages. (3 pages of English translation and 3 pages of Official copy).
"Office Action received for Korean Patent Application No. 10-2023-7024588, mailed on Dec. 17, 2024", 10 pages. (5 pages of English translation and 5 pages of Official copy).
"Office Action received for Russian Patent Application No. 2023119472/05, mailed on Dec. 20, 2023", 20 pages. (7 pages of English translation and 13 pages of Official copy).
Ishlinsky, "Polytechnic Dictionary", Moscow, Soviet Encyclopedia, 3rd Edition, col. 1, p. 420, 1989, 4 pages. (2 pages of English translation and 2 pages of Official copy).
Kazyaev, et al., "Mathematical Modeling of Stress State in Working Rolls of Cold Rolling During Accelerated Heating in a Chamber Furnace", News of higher educational institutions. Ferrous metallurgy, 2015, 58(9): 696-702, 14 pages. (7 pages of English translation and 7 pages of Official copy).
Rumyantseva, "Physical and Technological Properties of Coatings", Study guide, Ivanovo, 2007, 168 pages.
Shvedkov, et al., "Dictionary-Reference Guide to Powder Metallurgy", Kyiv, Naukova Dumka, p. 176, 1982, 4 pages. (2 pages of English translation and 2 pages of Official copy).
"Preliminary Office Action received for Brazilian Patent Application No. BR112023014602-0, mailed on Jun. 16, 2025", 7 pages (3 pages of English translation and 4 pages of Official copy).
Examination report of Intellectual Property India, Dispatched Jan. 29, 2026.

* cited by examiner

ALUMINUM PLATED STEEL SHEET, THERMOFORMED COMPONENT, AND MANUFACTURING METHODS

CROSS-REFERENCE TO RELATED APPLICATIONS

The present application is the U.S. National Stage application of International Application No. PCT/CN2021/140835, filed Dec. 23, 2021, which International Application was published on Aug. 4, 2022, as International Publication No. WO2022/161049. The International Application claims priority to Chinese Patent Application No. 202110119239.0, filed Jan. 28, 2021, the contents of which are incorporated herein by reference in their entireties.

TECHNICAL FIELD

The present invention relates to the field of metal plated steel sheets, particularly an aluminum plated steel sheet, a thermoformed component, and manufacturing methods.

BACKGROUND

Aluminum plated steel sheets are widely used in various fields such as automobiles, household appliances, ovens, and furnaces due to their good heat resistance and corrosion resistance. An aluminum plating layer can prevent oxidation and decarburization of a steel sheet during heat treatment due to the high temperature oxidation resistance. Therefore, the aluminum coatings are widely used in the field of thermoformed steel (especially hot stamped steel). The global demand for aluminum plated hot stamped steel is approximately 2 million tons. However, the thermoforming of the aluminum plated steel sheet also faces some challenges, such as the problems of aluminum melting-induced roller sticking, and the hydrogen embrittlement risk during heat treatment.

The problem of aluminum melting-induced roller sticking reduces the production efficiency and the quality of thermoformed components. To improve this problem, researchers generally aim to control the heating rate to avoid aluminum melting caused by rapid heating. For example, the patent CN101583486B explicitly proposes that a heating rate of an aluminum plated steel sheet between 20-700° C. should not exceed 12° C./s. The patent CN109518114A also discloses a stepped heating method to prevent aluminum melting-induced roller sticking and reduce the heating rate.

The risk of the hydrogen embrittlement will affect the properties such as delayed cracking resistance of the thermoformed component. To reduce the risk of hydrogen embrittlement of aluminum-silicon hot stamped steel, the patent CN100471595C discloses a hot stamping method, wherein the risk of hydrogen embrittlement of hot stamped components is reduced by controlling the atmosphere of a hot pressing process. The patent CN104160050B discloses hot stamped steel, wherein the risk of hydrogen embrittlement of a steel sheet is reduced by increasing the concentration of Mn-containing inclusions and Mn oxides in the steel.

The present invention provides an aluminum plated steel sheet, a thermoformed component, and manufacturing methods in response to the deficiencies of existing products and technologies.

SUMMARY

An object of the present invention is to solve the problems of melting-induced roller sticking and hydrogen embrittlement risk that occur during the heat treatment process when manufacturing thermoformed components from aluminum plated steel sheets. The present invention provides an aluminum plated steel sheet, a thermoformed component, and manufacturing methods, which can alleviate the issues of melting-induced roller sticking and hydrogen embrittlement risk during the thermoforming process of the aluminum plated steel sheets.

The present invention provides an aluminum plated steel sheet, comprising a substrate and a plating layer on the surface of the substrate, wherein a microstructure of the plating layer includes a $Mg_2Si$ phase and an AlMgSiFe phase, and the $Mg_2Si$ phase has an average grain diameter of 0.001-5 μm.

By adopting the above technical solution, the problems of melting-induced roller sticking and the hydrogen embrittlement risk during heat treatment of manufacturing the thermoformed components from the aluminum plated steel sheets can be alleviated, and the red rust resistance of the thermoformed components manufactured from the aluminum plated steel sheets can be improved.

Preferably, the plating layer includes a surface layer and a barrier layer, wherein the surface layer comprises the $Mg_2Si$ phase and the AlMgSiFe phase.

Preferably, the plating layer further includes a barrier layer, wherein the barrier layer comprises Fe—Al and Fe—Al—Si alloys, and the barrier layer has a thickness of less than or equal to 5 μm.

Preferably, the plating layer of the aluminum plated steel sheet has a thickness of 5-50 μm.

Preferably, a composition of the substrate of the aluminum plated steel sheet comprises in percentage by mass: 0.05-0.5% of C, 0.01-2.0% of Si, 0.3-3.0% of Mn, 0.005-0.3% of Al, $0.01\% \leq Ti < 0.1\%$, $0.0005\% \leq B < 0.1\%$, $0.05\% \leq Cr < 0.5\%$, $0.0005\% \leq Nb < 0.1\%$, and Fe.

Preferably, the composition of the substrate of the aluminum plated steel sheet comprises in percentage by mass: 0.05-0.5% of C, 0.01-2.0% of Si, 0.3-3.0% of Mn, 0.005-0.3% of Al, $0.01\% \leq Ti < 0.1\%$, $0.0005\% \leq B < 0.1\%$, $0.05\% \leq Cr < 0.5\%$, $0.0005\% \leq Nb < 0.1\%$, with the balance being Fe and inevitable impurities.

Preferably, among the inevitable impurities, in percentage by mass, $P < 0.3\%$, $S < 0.1\%$, and $V < 0.1\%$.

The present invention also provides a manufacturing method for the above aluminum plated steel sheet, including the following steps:

smelting;

rolling; and continuous annealing and hot plating, wherein the annealing temperature is 710-780° C., the temperature of a plating solution is 600-660° C., the temperature of the plating solution minus the temperature of a steel plate entering a plating pot is less than or equal to 5° C., the steel sheet is cooled after exiting the plating pot, an average cooling rate from the temperature of the steel plate exiting the plating pot to the plating layer solidification temperature is greater than 15° C./s, and an average cooling rate from the temperature of the steel plate exiting the plating pot to 200° C. is 10-30° C./s.

Preferably, a chemical composition of the plating solution includes: 5-11% by mass of Si, and 0.5-20% by mass of Mg.

Preferably, the plating solution further comprises 1-10% Zn by mass.

Preferably, the balance of the plating solution is Al and inevitable impurities.

Preferably, the rolling step includes hot rolling, wherein a coiling temperature of the hot rolling is 630° C. or less.

Preferably, the rolling step includes cold rolling, wherein a deformation during the cold rolling is 10-70%.

The present invention also provides a thermoformed component manufactured from the above aluminum plated steel sheet.

Preferably, the thermoformed component comprises a surface layer and an interior layer, wherein a ratio of the mass percentage of Mg of the surface layer to the mass percentage of Mg of the interior layer is greater than or equal to 5, and the thermoformed component has a core hardness HV1 of 300 or more.

The present invention further provides a manufacturing method for the above thermoformed component, including the following steps:

processing the aluminum plated steel sheet into a billet;

performing heat treatment on the billet, wherein a heating manner of the heat treatment is single-stage heating or stepped heating; when the heating manner of the heat treatment is single-stage heating, the stopping temperature of heating is a certain temperature in 900-1000° C., and the total heating time is 10-600 seconds; and when the heating manner of the heat treatment is stepped heating, the stopping temperature of heating comprises multiple temperatures in 700-1000° C., and the total heating time is 1-15 minutes, wherein the highest temperature of the multiple temperatures is a certain temperature in 900-1000° C., and the holding time of the billet at 900-1000° C. is 10-600 seconds; and transferring the billet to a mold for thermoforming, wherein the temperature of the billet when transferred to the mold is 650° C. or more, and a cooling rate of the mold is 30° C./s or higher.

Preferably, a process of thermoforming is hot stamping or hot rolling.

Preferably, a step of thickening rolling is further performed before processing the aluminum plated steel sheet into a billet.

REFERENCE NUMERALS

Figure 1:
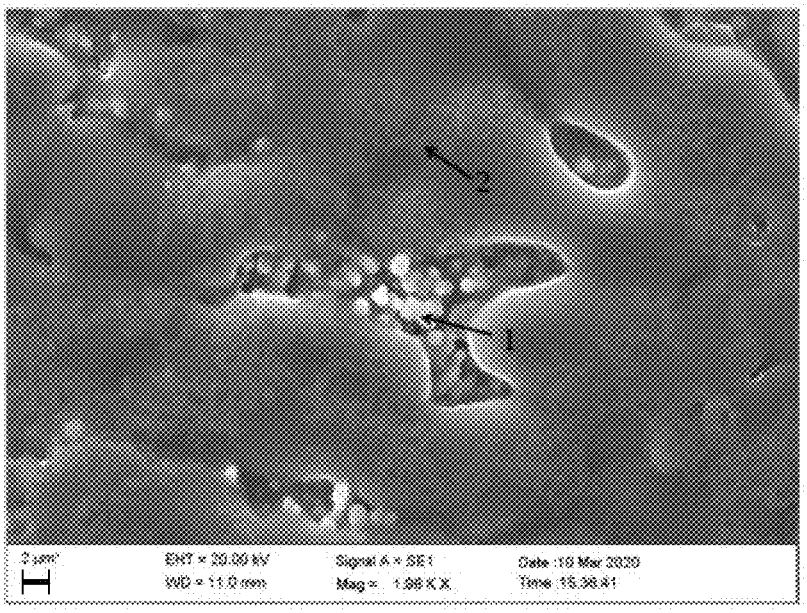
FIG. 1 shows a scanning spectrum of a plating layer of an aluminum plated steel sheet of Example 2 of the present invention.

1. $Mg_2Si$ phase; and 2. AlMgSiFe phase

DETAILED DESCRIPTION

Implementation modes of the present invention are illustrated below by specific embodiments. Those skilled in the art can easily understand other advantages and effects of the present invention based on the content disclosed in the specification. Although the description of the present invention will be introduced in conjunction with preferred embodiments, this does not represent that the features of the present invention are only limited to the embodiments. On the contrary, the description of the present invention in conjunction with the implementation modes is intended to cover other alternatives or modifications that may be derived from the claims of the present invention. In order to provide a thorough understanding of the present invention, the following description will include many specific details. However, the present invention can also be implemented without using these specific details. Furthermore, some specific details will be omitted in the description in order to avoid confusion or obscuring the focus of the invention. It should be noted that unless conflicting, the embodiments in the invention and features in the embodiments can be combined with each other.

It should be noted that in this description, similar reference numerals and letters denote similar items in the following drawings. Therefore, once an item is defined in one drawing, further definition and explanation are not necessary in subsequent drawings.

In the description of the embodiment, it should be noted that the terms "in" and the like indicate an orientation or positional relationship based on the orientation or positional relationship shown in the drawings, or the customary orientation or positional relationship when the invention is used, which is for the convenience of describing the invention and simplifying the description. It does not indicate or imply that the device or element being referred to must have a specific orientation, be constructed and operated in a specific orientation, and therefore, should not to be construed as a limitation on the present invention.

To make the objective, the technical solutions and the advantages of the present invention clearer, the implementation modes of the present invention are further described in detail in conjunction with the accompanying drawings.

The present invention provides an aluminum plated steel sheet, comprising a substrate and a plating layer on the surface of the substrate, wherein a microstructure of the plating layer includes a $Mg_2Si$ phase and an AlMgSiFe phase, and the $Mg_2Si$ phase has an average grain diameter of 0.001-5 μm.

The formation of the $Mg_2Si$ phase and the AlMgSiFe phase in the plating layer can reduce the proportion of Al phase or Al—Si phase in a plating layer, which is mainly composed of Al, break the agglomeration of these Al-containing phases on the surface of the plating layer, and disperse them as much as possible, thereby reducing the melting of aluminum during heat treatment, alleviating the issue of aluminum melting-induced roller sticking during heat treatment. This allows the aluminum plated steel sheet to withstand a faster heating rate to improve the production efficiency. Additionally, it reduces the probability of aluminum reacting with $H_2O$ in the atmosphere during heat treatment to generate $H_2$, minimizing the content of $H_2$ in the atmosphere during heat treatment, and thereby mitigating the risk of hydrogen embrittlement.

In the embodiment of the present invention, the average grain diameter of the $Mg_2Si$ phase in the high-quality plating layer is 0.001-5 μm. The smaller the average grain diameter of the $Mg_2Si$ phase, the easier it is to distribute on the surface of the plating layer, which is more conducive to reducing the risk of hydrogen embrittlement.

Preferably, the plating layer includes a surface layer comprising the $Mg_2Si$ phase and the AlMgSiFe phase.

The plating layer mainly consists of an Al phase and a Si-rich phase, with the $Mg_2Si$ phase and the AlMgSiFe phase uniformly distributed in a clustered or networked manner within the surface layer. Since a Mg-containing phase easily accumulates on the surface of the plating layer, the $Mg_2Si$ phase and the AlMgSiFe phase in the plating layer are preferentially distributed on the surface of the plating layer during heat treatment. This effectively blocks the diffusion or penetration of $H_2$ from the external atmosphere into the substrate, and further reduces the risk of hydrogen embrittlement.

The aforementioned plating layer further includes a barrier layer comprising Fe—Al and Fe—Al—Si alloys, and the barrier layer has a thickness of less than or equal to 5 μm.

When a substrate mainly composed of Fe is immersed in a plating solution mainly composed of Al and Si, the molten Al and Si will naturally alloy with Fe on the surface of the substrate, forming a barrier layer mainly composed of Fe—Al and Fe—Al—Si alloys. The barrier layer is positioned between the substrate of the steel sheet and the surface layer of the plating layer. In the process of actual production, the thickness of the plating barrier layer can be adjusted by controlling the immersion time of the steel sheet in the plating solution and other conditions. In the embodiments of the present invention, the thickness of the barrier layer should be controlled to be within 5 μm. If the thickness of the barrier layer is too large, it may affect the changes in microstructure of the plating layer during cooling, preventing the formation of the $Mg_2Si$ phase and the AlMgSiFe phase, causing excessively large grain sizes, and potentially leading to the delamination of the surface layer during subsequent thermoforming.

Preferably, the plating layer of the aluminum plated steel sheet has a thickness of 5-50 μm.

During actual production, the thickness of the plating layer can be controlled by adjusting the immersion time of the substrate in the plating solution, the airflow intensity of an air knife, and the like. Longer the immersion time results in thicker the plating layer, while higher airflow intensity of the air knife leads to a thinner plating layer.

Preferably, a composition of the substrate of the aluminum plated steel sheet comprises in percentage by mass: 0.05-0.5% of C, 0.01-2.0% of Si, 0.3-3.0% of Mn, 0.005-0.3% of Al, $0.01\% \leq Ti < 0.1\%$, $0.0005\% \leq B < 0.1\%$, $0.05\% \leq Cr < 0.5\%$, $0.0005\% \leq Nb < 0.1\%$, and Fe.

Preferably, the composition of the substrate of the aluminum plated steel sheet comprises in percentage by mass: 0.05-0.5% of C, 0.01-2.0% of Si, 0.3-3.0% of Mn, 0.005-0.3% of Al, $0.01\% \leq Ti < 0.1\%$, $0.0005\% \leq B < 0.1\%$, $0.05\% \leq Cr < 0.5\%$, $0.0005\% \leq Nb < 0.1\%$, with the balance being Fe and inevitable impurities.

In the composition of the substrate, P, S, and V elements are inevitable impurities, the lower their content in the substrate, the better. Specifically, in the embodiments of the present application, in percentage by mass, $P < 0.3\%$, $S < 0.1\%$, and $V < 0.1\%$.

The present invention also provides a manufacturing method for the above aluminum plated steel sheet, including the following steps:

smelting;

rolling; and continuous annealing and hot plating, wherein the annealing temperature is 710-780° C., the temperature of a plating solution is 600-660° C., the temperature of the plating solution minus the temperature of a steel plate entering a plating pot is less than or equal to 5° C., the steel sheet is cooled after exiting the plating pot, an average cooling rate from the temperature of the steel plate exiting the plating pot to the plating layer solidification temperature is greater than 15° C./s, and an average cooling rate from the temperature of the steel plate exiting the plating pot to 200° C. is 10-30° C./s.

If the annealing temperature is below 710° C., it may affect the platability of the steel sheet, causing missed plating or poor plating adhesion of the plating layer. If the annealing temperature exceeds 780° C., it may lead to energy waste and further affect the surface condition of the steel sheet, which can impact the surface quality of the plating layer, and the grain size of the $Mg_2Si$ phase and the formation of the AlMgSiFe phase in the plating layer.

The temperature of the plating solution will affect the alloying reaction of molten Al and Fe, thereby affecting the composition and thickness of the barrier layer. In the present application, the temperature of the plating solution is controlled within the range of 600-660° C., and the temperature of the steel sheet entering the plating pot is controlled to be slightly lower than the temperature of the plating solution in order to obtain a barrier layer having an appropriate thickness and microstructure, ensuring the formation of the desired AlMgSiFe phase and $Mg_2Si$ phase in the surface layer during subsequent processing and preventing the detachment of the surface layer.

High or low temperature of the plating solution, as well as a significant difference between the temperature of the steel sheet entering the plating pot and the temperature of the plating solution, can affect the surface quality of the plating layer, and the grain size of the $Mg_2Si$ phase, and the formation of the AlMgSiFe phase in the plating layer. This can result in an average grain diameter of the $Mg_2Si$ phase of greater than 5 μm and/or that the inability to form the AlMgSiFe phase. If the average particle size of the $Mg_2Si$ phase in the plating layer is too large, the surface of the plating layer will be noticeably rough, affecting the appearance of the steel plate.

The average cooling rate from the temperature of the steel plate exiting the plating pot to the solidification temperature of the plating layer, as well as the average cooling rate from the temperature of the steel plate exiting the plating pot to 200° C., are both important. If these two cooling rates are too slow, the growth rate of the Al—Si phase will be too fast, inhibiting formation of the $Mg_2Si$ phase and the AlMgSiFe phase. Consequently, the ability to overcome the issues of melting-induced roller sticking and the hydrogen embrittlement risk encountered during the thermoforming process of the aluminum plated steel sheet in the present application, cannot be achieved. Moreover, excessively slow cooling rates can result in the precipitation of large-grain $Mg_2Si$ phase and the AlMgSiFe phase in the plating layer, resulting in a rough surface of the plating layer, affecting the appearance of the product. Conversely, if these two cooling rates are too fast, it may cause excessive strength of the steel sheet, damaging its elongation or causing other secondary damages, such as surface scratches.

The temperature of the steel sheet entering the plating pot can be adjusted according to the thickness and width of the steel sheet. The temperature of the steel sheet entering the plating pot and an appropriate fast cooling rate after exiting the plating pot (including the average cooling rate from the temperature of the steel plate exiting the plating pot to the plating layer solidification temperature, and the average cooling rate from the temperature of the steel plate exiting the plating pot to 200° C.) can further improve the uniform distribution and grain refinement of the $Mg_2Si$ phase and the AlMgSiFe phase in the surface layer.

During the process of continuous annealing and hot plating, control of the cooling rate can be achieved by adjusting the power of a blower.

Preferably, a chemical composition of the plating solution includes in percentage by mass: 5-11% of Si, and 0.5-20% of Mg.

Si in the plating solution is essential, mainly to inhibit the thickness of the barrier layer. If the Si content in the plating solution is too low, the thickness of the barrier layer will be too thick, resulting in poor workability of the steel sheet. On the other hand, and if the Si content in the plating solution is too high, its inhibiting effect on the barrier layer will be limited, while also affecting the fluidity of the plating solution and increasing the difficulty of production. Therefore, the Si content in the plating solution is 5-11%. The presence of Mg in the plating layer is mainly to improve the corrosion resistance and promote the formation of the $Mg_2Si$ phase. Mg in the plating layer comes from the plating solution, when the Mg content in the plating solution exceeds a certain value, the $Mg_2Si$ phase can be formed during cooling. However, the solubility of Mg in Al—Si plating solution is limited, and if the Mg content in the plating solution is too high, Mg is very easily oxidized to form slags, causing production difficulties. Hence, the Mg content in the plating solution is 0.5-20%.

Preferably, the plating solution further comprises 1-10% by mass of Zn. Zn in the plating layer serves as sacrificial anodes, providing sacrificial protection and enhancing the corrosion resistance of steel.

Preferably, the balance of the plating solution is Al and inevitable impurities.

Preferably, the step of rolling includes hot rolling, wherein a coiling temperature of the hot rolling is 630° C. or less. If the coiling temperature is too high, it may cause excessive oxide scale on the surface of the steel sheet, which cannot be completely removed during pickling after rolling, thus affecting the surface quality of the plating layer during subsequent aluminum plating.

Preferably, the rolling step further includes cold rolling. If the steel sheet produced from the aforementioned hot rolling step does not meet the requirements for user applications, further cold rolling can be performed on the hot rolled steel coil. In the embodiments of the present application, a deformation during the cold rolling is 10-70%.

The aluminum plated steel sheet can be used for direct cold stamping forming or hot stamping forming.

The present invention further provides a thermoformed component manufactured from the above aluminum plated steel sheet.

Preferably, the thermoformed component includes a surface layer and an interior layer, wherein a ratio of the mass percentage of Mg of the surface layer to the mass percentage of Mg of the interior layer is greater than or equal to 5, and the thermoformed component has a core hardness HV1 of 300 or more.

During the thermoforming process of the aluminum plated steel sheet, the previously formed surface layer and barrier layer of the plating layer are transformed into the surface layer and the interior layer of the thermoformed component. The corresponding microstructure will also change. The surface layer, originally composed of Al—Si alloy, will transform into Fe—Al—Si alloy. The Fe—Al—Si alloy barrier layer will further undergo alloy diffusion, with an increased content of Fe. The interior layer of the component refers to the substrate of the thermoformed component to the dark Fe-rich layer within the plating layer, and the surface layer extends from the dark Fe-rich layer within the plating layer to the surface of the plating layer.

The $Mg_2Si$ phase and the AlMgSiFe phase are distributed in the surface layer of the plating layer, and they are still preferentially distributed on the surface of the plating layer during the heat treatment. After the heat treatment, Mg is mainly distributed in the surface layer of the component, and the ratio of the mass percentage of Mg of the surface layer to that of the interior layer of the component is greater than or equal to 5, which is determined by the aggregation characteristics of Mg. Due to the abundant presence of Mg on the surface of the thermoformed component, the red rust resistance of the thermoformed component during transportation and storage can be improved.

The substrate of the aluminum plated steel sheet will transform into a core of the thermoformed component after thermoforming. The microstructure of the core of the thermoformed component comprises one or more of martensite, bainite, and ferrite. The specific composition and content depend on the composition of the substrate and the cooling rate of a mold during thermoforming. The final microstructure of the core will affect the core hardness of the thermoformed component.

The present invention also provides a manufacturing method for the above thermoformed component, including the following steps:

processing the aluminum plated steel sheet into a billet;

performing heat treatment on the billet, wherein a heating manner of the heat treatment is single-stage heating or stepped heating; when the heating manner of the heat treatment is single-stage heating, the stopping temperature of heating is a certain temperature in 900-1000° C., and the total heating time is 10-600 seconds; and when the heating manner of the heat treatment is stepped heating, the stopping temperature of stepped heating includes multiple temperatures in 700-1000° C., and the total heating time is 1-15 minutes, wherein the highest temperature of the multiple temperatures is a certain temperature in 900-1000° C., and the holding time of the billet at 900-1000° C. is 10-600 seconds; and transferring the billet to the mold for thermoforming, wherein the temperature of the billet when transferred to the mold is 650° C. or more, and a cooling rate of the mold is 30° C./s or higher. In the embodiments of the present application, water cooling is applied to the thermoforming mold, and the cooling rate of the mold is controlled by adjusting conditions such as a flow, a flow rate, and a pressure of the cooling water.

When the heating manner of the heat treatment is single-stage heating, the stopping temperature of heating is a certain temperature within 900-1000° C., and the total heating time is the time from the start of heating the billet to the end. When the heating manner of the heat treatment is stepped heating, the stopping temperature includes multiple temperatures within the range of 700-1000° C., and the total heating time is the time from the start of heating the billet to the end. A final heating stopping temperature needs to be 900° C. or above, whether single-stage heating or stepped heating to ensure complete austenitization of the steel and prepare for the formation of the desired structure during cooling. An upper limit of the heating stopping temperature is set at 1000° C. for energy saving.

Preferably, a process of thermoforming is hot stamping or hot rolling.

Preferably, a step of thickening rolling is further performed before processing the aluminum plated steel sheet into a billet.

Examples 1-6 and Comparative Examples 1-2

Aluminum plated steel sheets and thermoformed components of Examples 1-6 and Comparative examples 1-2 were manufactured by using the following manufacturing method.

Step 1: Smelting to obtain a substrate with a composition as shown in Table 1.

Step 2: Rolling to obtain a rolled steel sheet. After rolling, pickling was performed to remove an oxide layer on the surface of the steel sheet.

Step 3: Continuous annealing and hot plating, in which the rolled steel sheet was subjected to continuously annealing, and then put into a plating pot (immersed into a plating solution). The steel sheet was cooled after immersion to obtain the aluminum plated steel sheet.

The specific process parameters for rolling and continuous annealing and hot plating are shown in Table 2.

Step 4: Processing the aluminum plated steel sheet into a billet.

Step 5: Heat treating the billet.

Step 6: Transferring the heat-treated billet to a mold for thermoforming to obtain the thermoformed component.

The specific process parameters for heat treatment and thermoforming are shown in Table 3.

The aluminum plated steel sheets and thermoformed components of Examples 1-6 and Comparative examples 1-2 were tested according to the following test methods, and the test results are shown in Tables 2 and 3.

1) Average Grain Diameter of the $Mg_2Si$ Phase (μm)

A grain size was calculated by using an intercept method. The average grain diameter=the length/the number of grains in an intercepted section.

2) Presence of AlMgSiFe Phase

Observed using an EVO10 Zeiss scanning electron microscope, combined with energy dispersive X-ray spectrometer (EDS) analysis, with "√" indicating the presence and "/" indicating the absence.

3) Roller Sticking Phenomenon

Judged by visual inspection. "x" indicates no sticking occurrence, and "√" indicates sticking occurrence.

4) Hydrogen Embrittlement Resistance

The hydrogen content of the thermoformed component was evaluated using a G4-PHONEX micro hydrogen concentration analyzer. The maximum heating temperature did not exceed 400° C. The amount of hydrogen released was recorded, and a higher the released amount indicates poorer hydrogen embrittlement resistance. The rating scale ranges from 1 (worst) to 5 (best).

5) Mass Percentage of Mg in a Surface Layer of the Component/Mass Percentage of Mg of an Interior Layer of the Component Tested using a GDS850A glow discharger spectrometer. The interior layer of the component refers to the substrate of the thermoformed component up to a dark Fe-rich layer in the plating layer, and the surface layer of the component refers to the dark Fe-rich layer in the plating layer up to the surface of the plating layer.

6) Red Rust Resistance

Evaluated using a neutral salt spray test. The thermoformed component to be evaluated had no electrophoretic coating. After 24 hours, the degree of red rust coverage is assessed, with less than 5% coverage indicating the best performance. In this experiment, a rating scale of 1 (worst) to 5 (best) is used.

7) Core Hardness HV1

Determined according to the GB/T 4340.1-2009 standard for Vickers hardness of the thermoformed component.

FIG. 1 is obtained by scanning a plating layer of an aluminum plated steel sheet obtained in Example 2 of the present invention using a Zeiss field emission electron microscope.

Figure 2:
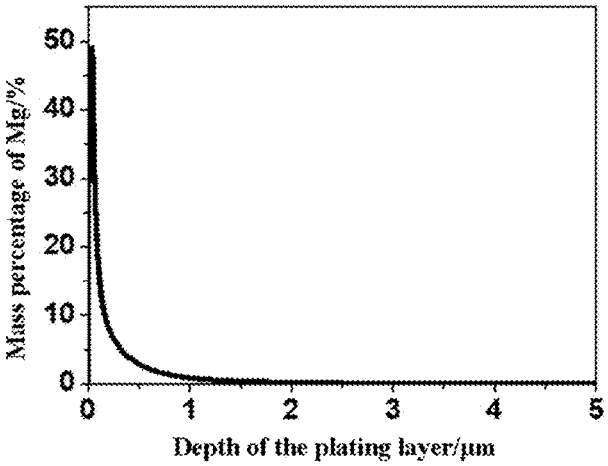
FIG. 2 shows the mass percentage of Mg in a plating layer of a thermoformed component of Example 2 of the present invention as a function of the depth of the plating layer.

A thermoformed component obtained in Example 2 of the present invention was tested using a GDS850A glow discharge spectrometer to obtain FIG. 2 which shows the variation of the mass percentage of Mg as a function of the depth of the plating layer.

Table 1 shows the composition of chemical elements of substrates in Examples 1-6 and Comparative Examples 1-2.

TABLE 1

(%, the balance being Fe and other inevitable impurities besides P, S, and V)

| No. | C | Si | Mn | P | S | Al | Ti | B | Cr | Nb | V |
|---|---|---|---|---|---|---|---|---|---|---|---|
| Example 1 | 0.05 | 0.05 | 1.90 | 0.059 | 0.038 | 0.006 | 0.090 | 0.0005 | 0.05 | 0.0031 | 0.0051 |
| Example 2 | 0.23 | 0.23 | 1.19 | 0.015 | 0.001 | 0.04 | 0.010 | 0.0040 | 0.23 | 0.0010 | 0.0010 |
| Example 3 | 0.29 | 0.50 | 2.51 | 0.024 | 0.04 | 0.08 | 0.027 | 0.0052 | 0.21 | 0.0005 | 0.0022 |
| Example 4 | 0.36 | 0.36 | 1.50 | 0.044 | 0.03 | 0.07 | 0.05 | 0.0062 | 0.41 | 0.0062 | 0.0012 |
| Example 5 | 0.50 | 0.48 | 0.40 | 0.081 | 0.02 | 0.05 | 0.090 | 0.0071 | 0.20 | 0.071 | 0.0021 |
| Example 6 | 0.15 | 1.80 | 2.90 | 0.039 | 0.038 | 0.29 | 0.090 | 0.0031 | 0.15 | 0.0031 | 0.0031 |
| Comparative Example 1 | 0.23 | 0.23 | 1.19 | 0.015 | 0.001 | 0.04 | 0.030 | 0.0040 | 0.23 | 0.0010 | 0.0010 |
| Comparative Example 2 | 0.20 | 0.20 | 1.31 | 0.024 | 0.004 | 0.08 | 0.027 | 0.0052 | 0.21 | 0.0005 | 0.0022 |

Table 2 shows the process parameters for rolling and continuous annealing and hot plating, the composition of a plating solution, and the microstructure and thickness of a plating layer of the steel sheets of Examples 1-6 and Comparative examples 1-2.

TABLE 2

| | Rolling | | Continuous annealing and hot plating | | | | |
|---|---|---|---|---|---|---|---|
| No. | Hot rolling coiling temperature/° C. | Cold rolling deformation/% | Annealing temperature/° C. | Temperature of a plating solution/° C. | Temperature of a steel plate entering a pot/° C. | The temperature of the plating solution − the temperature of the steel plate entering the plating pot/° C. | Average cooling rate from the temperature of the steel plate exiting the plating pot to the plating layer solidification temperature/° C./s |
| Example 1 | 600 | 60 | 710 | 600 | 605 | 5 | 16 |
| Example 2 | 630 | 50 | 730 | 620 | 620 | 0 | 18 |
| Example 3 | 610 | 45 | 750 | 630 | 633 | 3 | 20 |
| Example 4 | 550 | 40 | 760 | 650 | 645 | 5 | 25 |
| Example 5 | 500 | 10 | 780 | 650 | 650 | 0 | 30 |
| Example 6 | 600 | 70 | 770 | 660 | 660 | 0 | 35 |
| Comparative Example 1 | 600 | 50 | 730 | 620 | 620 | 0 | 10 |
| Comparative Example 2 | 630 | 60 | 750 | 650 | 670 | 20 | 5 |

| | Continuous annealing and hot plating | | | | Plating layer | | |
|---|---|---|---|---|---|---|---|
| | Average cooling rate from the temperature of the steel plate exiting the plating pot to | Chemical composition of the plating solution | | | Average grain diameter of a $Mg_2Si$ | AlMgSiFe | Thickness/ |
| No. | 200° C./° C./s | Si/% | Mg/% | Zn/% | phase/μm | phase | μm |
| Example 1 | 10 | 5 | 0.5 | / | 5 | ✓ | 5 |
| Example 2 | 15 | 9 | 1 | / | 4 | ✓ | 20 |
| Example 3 | 18 | 7 | 5 | 5 | 3 | ✓ | 17 |
| Example 4 | 20 | 8 | 10 | 10 | 2 | ✓ | 28 |
| Example 5 | 25 | 9 | 15 | 1 | 2 | ✓ | 30 |
| Example 6 | 30 | 11 | 20 | 5 | 1 | ✓ | 50 |
| Comparative Example 1 | 10 | 9 | / | / | / | / | 20 |
| Comparative Example 2 | 8 | 8 | 0.3 | 7 | / | / | 23 |

Table 3 shows the process parameters for heat treatment, whether the roller sticking phenomenon occurred, and the process parameters for thermoforming of aluminum plated steel sheets, and the properties of thermoformed components in Examples 1-6 and Comparative Examples 1-2.

TABLE 3

| | Heat treatment | | | | | |
|---|---|---|---|---|---|---|
| No. | Heating manner | Heating stopping temperature/° C. | Total heating time/min | Maximum heating temperature/° C. | Time at a set temperature of 900-1000° C./s | Roller sticking phenomenon |
| Example 1 | single-stage | 900 | 1 | 900 | 60 | x |
| Example 2 | Stepped | 720-930 | 6 | 930 | 300 | x |
| Example 3 | Stepped | 750-945 | 5 | 945 | 240 | x |
| Example 4 | Stepped | 760-950 | 5 | 950 | 180 | x |
| Example 5 | Stepped | 750-910 | 15 | 910 | 600 | x |
| Example 6 | Stepped | 700-1000 | 2.5 | 1000 | 10 | x |

TABLE 3-continued

| | | | | | | |
|---|---|---|---|---|---|---|
| Comparative Example 1 | Stepped | 720-930 | 6 | 930 | 300 | ✓ |
| Comparative Example 2 | Stepped | 720-930 | 6 | 930 | 250 | ✓ |

| | Thermoforming | | Thermoformed component | | | |
|---|---|---|---|---|---|---|
| No. | Temperature of a billet when transferred to a mold/° C. | Mold cooling rate ° C./s | Hydrogen embrittlement resistance | Mass percentage of Mg of a surface layer/that of an interior layer | Red rust resistance | Core hardness HV1 |
| Example 1 | 650 | 30 | 4 | 5 | 4 | 305 |
| Example 2 | 680 | 38 | 5 | 6 | 4 | 400 |
| Example 3 | 700 | 37 | 4 | 7 | 5 | 450 |
| Example 4 | 780 | 50 | 5 | 8 | 5 | 470 |
| Example 5 | 750 | 60 | 5 | 9 | 5 | 480 |
| Example 6 | 700 | 70 | 5 | 10 | 5 | 350 |
| Comparative Example 1 | 600 | 25 | 2 | / | 2 | 250 |
| Comparative Example 2 | 600 | 25 | 2 | 3 | 3 | 250 |

From Tables 1-3, it can be seen that for aluminum plated steel sheets obtained in Examples 1-6 exhibit a microstructure of a plating layer comprising a $Mg_2Si$ phase and an AlMgSiFe phase. The average grain diameter of the $Mg_2Si$ phase is 1-5 μm. During heat treatment, no melting-induced roller sticking phenomenon occurs. The thermoformed components obtained in Examples 1-6 are excellent in hydrogen embrittlement resistance, with a ratio of the mass percentage of Mg in a surface layer to that of Mg in an interior layer being greater than or equal to 5. Additionally, the thermoformed components exhibit excellent resistance to red rust resistance and have a core hardness HV1 of 300 or more.

FIG. 1 is a scanning spectrum of a plating layer of an aluminum plated steel sheet of Example 2 of the present invention, and it can be seen that a microstructure of the plating layer comprises a $Mg_2Si$ phase and an AlMgSiFe phase. FIG. 2 shows the variation of the mass percentage of Mg in a thermoformed component of Example 2 of the present invention as a function of the depth of the plating layer, and it can be seen that the closer the measurement is to the surface of the plating layer, the higher the mass percentage of Mg.

In contrast, for Comparative Example 1, the average cooling rate from the temperature of the steel plate exiting the plating pot to the plating layer solidification temperature is too slow, at only 10° C./s. The chemical composition of the plating solution does not contain Mg, and the plating layer of the aluminum plated steel sheet does not contain the $Mg_2Si$ phase and the AlMgSiFe phase. The melting-induced roller sticking phenomenon occurs during heat treatment, the temperature of the billet when transferred to the mold is too low, at only 600° C., and the cooling rate of the mold is too low, at only 25° C./s. Consequently, the hydrogen embrittlement resistance and the red rust resistance of the thermoformed component are poor, and the core hardness HV1 is only 250.

For Comparative Example 2, there is a significant difference between the temperature of the plating solution and the temperature of the steel plate entering the plating pot, with a difference of 20° C. The average cooling rate from the temperature of the steel plate exiting the plating pot to the plating layer solidification temperature is too slow, at only 5° C./s, and the average cooling rate from the temperature of the steel plate exiting the plating pot to 200° C. is too slow, at only 8° C./s. The content of Mg in the plating solution is only 0.3%, and there are no $Mg_2Si$ phase and AlMgSiFe phase. The melting-induced roller sticking phenomenon occurs during heat treatment. The temperature of the billet when transferred to the mold is too low, at only 600° C., and the mold cooling rate is also low, at only 25° C./s. As a result, the hydrogen embrittlement resistance of the thermoformed component is poor, and the ratio of the mass percentage of Mg of the surface layer to that of the interior layer of the component is only 3. Additionally, the red rust resistance is poor, and the core hardness HV1 is only 250.

Since the processing parameters of the steel sheets of Comparative Examples 1 and 2 are not properly controlled during continuous annealing and hot plating and thermoforming, the resulting thermoformed components do not have the desired properties of the present application.

In summary, the present invention provides an aluminum plated steel sheet, a thermoformed component and manufacturing methods, which can alleviate the problem of melting-induced roller sticking and reduce the risk of hydrogen embrittlement during heat treatment of the aluminum plated steel sheet, while improving the red rust resistance of the thermoformed component.

Although the present invention has been illustrated and described with reference to some preferred embodiments of the present invention, it should be understood by those of ordinary skill in the art that the above content is a further detailed description of the present invention in conjunction with the specific embodiments, and it cannot be considered that the specific implementations of the present invention are limited only to the foregoing description. Those skilled in the art may make various changes in forms and details, including making certain deductions or substitutions, without departing from the spirit and scope of the present invention.

The invention claimed is:

1. An aluminum plated steel sheet, comprising a substrate and a plating layer on the surface of the substrate, wherein a microstructure of the plating layer comprises a $Mg_2Si$ phase and an AlMgSiFe phase, and the $Mg_2Si$ phase has an average grain diameter of 0.001-5 μm, wherein the plating layer comprises a barrier layer formed on the surface of the substrate and a surface layer formed on the barrier layer, wherein the barrier layer comprises Fe—Al and Fe—Al—Si alloys, and the surface layer contains the $Mg_2Si$ phase and the AlMgSiFe phase.

2. The aluminum plated steel sheet as claimed in claim 1, having the $Mg_2Si$ phase and the AlMgSiFe phase are distributed within the surface layer.

3. The aluminum plated steel sheet as claimed in claim 1, wherein the barrier layer has a thickness of less than or equal to 5 μm.

4. The aluminum plated steel sheet as claimed in claim 1, wherein the plating layer has a thickness of 5-50 μm.

5. The aluminum plated steel sheet as claimed in claim 1, wherein a composition of the substrate of the aluminum plated steel sheet comprises in percentage by mass: 0.05-0.5% of C, 0.01-2.0% of Si, 0.3-3.0% of Mn, 0.005-0.3% of Al, 0.01%≤Ti<0.1%, 0.0005%≤B<0.1%, 0.05%≤Cr<0.5%, 0.0005%≤Nb<0.1%, and Fe.

6. The aluminum plated steel sheet as claimed in claim 5, wherein the composition of the substrate of the aluminum plated steel sheet comprises in percentage by mass: 0.05-0.5% of C, 0.01-2.0% of Si, 0.3-3.0% of Mn, 0.005-0.3% of Al, 0.01%≤Ti<0.1%, 0.0005%≤B<0.1%, 0.05%≤Cr<0.5%, 0.0005%≤Nb<0.1%, with the balance being Fe and inevitable impurities.

7. The aluminum plated steel sheet as claimed in claim 6, wherein among the inevitable impurities, in percentage by mass, P<0.3%, S<0.1%, and V<0.1%.

8. A manufacturing method for the aluminum plated steel sheet as claimed in claim 1, comprising the following steps:

smelting;

rolling; and continuous annealing and hot plating, wherein the annealing temperature is 710-780° C., the temperature of a plating solution is 600-660° C., the temperature of the plating solution minus the temperature of a steel plate entering a plating pot is less than or equal to 5° C., the steel plate is cooled after exiting the plating pot, an average cooling rate from the temperature of the steel plate exiting the plating pot to the plating layer solidification temperature is greater than 15° C./s, and an average cooling rate from the temperature of the steel plate exiting the plating pot to 200° C. is 10-30° C./s.

9. The manufacturing method for the aluminum plated steel sheet as claimed in 8, wherein a chemical composition of the plating solution comprises in percentage by mass: 5-11% of Si, and 0.5-20% of Mg.

10. The manufacturing method for the aluminum plated steel sheet as claimed in claim 9, wherein the plating solution further comprises 1-10% by mass of Zn.

11. The manufacturing method for the aluminum plated steel sheet as claimed in claim 9, wherein the balance of the plating solution is Al and inevitable impurities.

12. The manufacturing method for the aluminum plated steel sheet as claimed in claim 8, wherein the rolling step comprises hot rolling, wherein a coiling temperature of the hot rolling is 630° C. or less.

13. The manufacturing method for the aluminum plated steel sheet as claimed in claim 12, wherein the rolling step comprises cold rolling, wherein a deformation during the cold rolling is 10-70%.

14. A thermoformed component, manufactured using the aluminum plated steel sheet as claimed in claim 1.

15. The thermoformed component as claimed in claim 14, wherein the thermoformed component comprises a surface layer and an interior layer, wherein a ratio of a mass percentage of Mg of the surface layer of the thermoformed component to that of the interior layer of the thermoformed component is greater than or equal to 5, and the thermoformed component has a core hardness HV1 of 300 or more.

16. A manufacturing method for the thermoformed component as claimed in claim 14, comprising the following steps:

processing the aluminum plated steel sheet into a billet;

performing heat treatment on the billet, wherein a heating manner of the heat treatment is single-stage heating or stepped heating; when the heating manner of the heat treatment is single-stage heating, the stopping temperature of heating is a certain temperature in 900-1000° C., and the total heating time is 10-600 seconds; and when the heating manner of the heat treatment is stepped heating, the stopping temperature of heating comprises multiple temperatures in 700-1000° C., and the total heating time is 1-15 minutes, wherein the highest temperature of the multiple temperatures is a certain temperature in 900-1000° C., and the holding time of the billet at 900-1000° C. is 10-600 s; and transferring the billet to a mold for thermoforming, wherein the temperature of the billet when transferred to the mold is 650° C. or more, and a cooling rate of the mold is 30° C./s or higher.

17. The manufacturing method for the thermoformed component as claimed in claim 16, wherein a process of the thermoforming is hot stamping or hot rolling.

18. The manufacturing method for the thermoformed component as claimed in claim 16, wherein a step of thickening rolling is further performed before processing the aluminum plated steel sheet into the billet.

19. The manufacturing method for the aluminum plated steel sheet as claimed in claim 10, wherein the balance of the plating solution is Al and inevitable impurities.

20. The manufacturing method for the thermoformed component as claimed in claim 17, wherein a step of thickening rolling is further performed before processing the aluminum plated steel sheet into the billet.

* * * * *